US012404124B2

(12) United States Patent
Duong

(10) Patent No.: US 12,404,124 B2
(45) Date of Patent: Sep. 2, 2025

(54) SHEET FEEDING DEVICE AND IMAGE FORMING APPARATUS

(71) Applicant: KYOCERA Document Solutions Inc., Osaka (JP)

(72) Inventor: Huy Quoc Duong, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 216 days.

(21) Appl. No.: 18/494,377

(22) Filed: Oct. 25, 2023

(65) Prior Publication Data

US 2024/0140744 A1 May 2, 2024

(30) Foreign Application Priority Data

Oct. 27, 2022 (JP) ..... 2022-172442

(51) Int. Cl.
*B65H 3/06* (2006.01)

(52) U.S. Cl.
CPC ..... *B65H 3/06* (2013.01); *B65H 2301/531* (2013.01)

(58) Field of Classification Search
CPC .. B65H 3/06; B65H 2301/531; G03G 21/169; G03G 2221/1618
USPC ..... 198/494, 496, 497, 499
See application file for complete search history.

(56) References Cited

U.S. PATENT DOCUMENTS

| | | | | |
|---|---|---|---|---|
| 7,641,188 | B2 * | 1/2010 | Hiura | B65H 3/5261 271/208 |
| 7,900,909 | B2 * | 3/2011 | Hiura | B65H 3/5261 271/208 |
| 9,016,690 | B2 * | 4/2015 | Fukunaga | B65H 5/26 271/273 |
| 12,234,114 | B2 * | 2/2025 | Sugiyama | B65H 3/0669 |

FOREIGN PATENT DOCUMENTS

JP 2009-269709 A 11/2009

* cited by examiner

*Primary Examiner* — Leslie A Nicholson, III
(74) *Attorney, Agent, or Firm* — Studebaker Brackett PLLC

(57) ABSTRACT

A sheet feeding device includes a sheet feeding roller, a sheet conveying roller, a separation roller, and a cleaning member. The sheet feeding roller is rotated to feed the sheet in a predetermined sheet feeding direction. The sheet conveying roller is disposed on a downstream side of the sheet feeding roller in the sheet feeding direction. The separation roller forms a separation nip between the sheet conveying roller and the separation roller. The cleaning member is disposed on an upstream side of the separation nip in the sheet feeding direction, and cleans a surface of the separation roller. The cleaning member is configured to be deformable to be separated from the surface of the separation roller when the sheet feeding roller does not feed the sheet and to come into contact with the surface of the separation roller by the sheet fed by the sheet feeding roller.

6 Claims, 6 Drawing Sheets

SHEET FEEDING DEVICE AND IMAGE FORMING APPARATUS

INCORPORATION BY REFERENCE

This application is based on and claims the benefit of priority from Japanese patent application No. 2022-172442 filed on Oct. 27, 2022, which is incorporated by reference in its entirety.

BACKGROUND

The present disclosure relates to a sheet feeding device which feeds a sheet from a sheet feeding cassette and an image forming apparatus.

The sheet feeding device includes a sheet feeding roller which feeds a sheet from a sheet feeding cassette and a sheet conveying roller which conveys the sheet fed by the sheet feeding roller downstream in the sheet feeding direction. The sheet conveying roller is in contact with a separation roller to form a separation nip. The sheets are conveyed as they are separated at the separation nip.

At the separation nip, sheet powder is easily generated by friction between the separation roller or the sheet conveying roller and the sheet, or between the sheets. If such the sheet powder adheres to each roller, the sheet conveying force may be deteriorated. Alternatively, if the sheet powder is scattered and adheres to the photosensitive drum or mixed into the developer, image failure may occur. Therefore, the image forming apparatus may be provided with a cleaning member.

The cleaning member is disposed on the upstream side of the separation nip in the sheet feeding direction, and has a free end that can come into contact with the surface of the separation roller to clean the surface of the roller.

However, the above-described cleaning member has a problem that the surface of the separation roller is easily worn by friction with the free end of the cleaning roller because the free end is always in contact with the surface of the separation roller. There is also a problem in which cleaning performance due to the wear of the free end may be deteriorated.

SUMMARY

A sheet feeding device according to the present disclosure includes a sheet feeding roller, a sheet conveying roller, a separation roller and a cleaning member. The sheet feeding roller comes into contact with a sheet and then is rotated to feed the sheet in a predetermined sheet feeding direction. The sheet conveying roller is disposed on a downstream side of the sheet feeding roller in the sheet feeding direction. The separation roller forms a separation nip between the sheet conveying roller and the separation roller, and conveys the sheet while separating the sheets at the separation nip. The cleaning member is disposed on an upstream side of the separation nip in the sheet feeding direction, and cleans a surface of the separation roller. The cleaning member is configured to be deformable to be separated from the surface of the separation roller when the sheet feeding roller does not feed the sheet and to come into contact with the surface of the separation roller by the sheet fed by the sheet feeding roller.

An image forming apparatus according to claim 1 includes the sheet feeding device; and an image forming part which forms an image on the sheet fed by the sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus and a sheet feeding device according to one embodiment of the present disclosure will be described.

Figure 1:
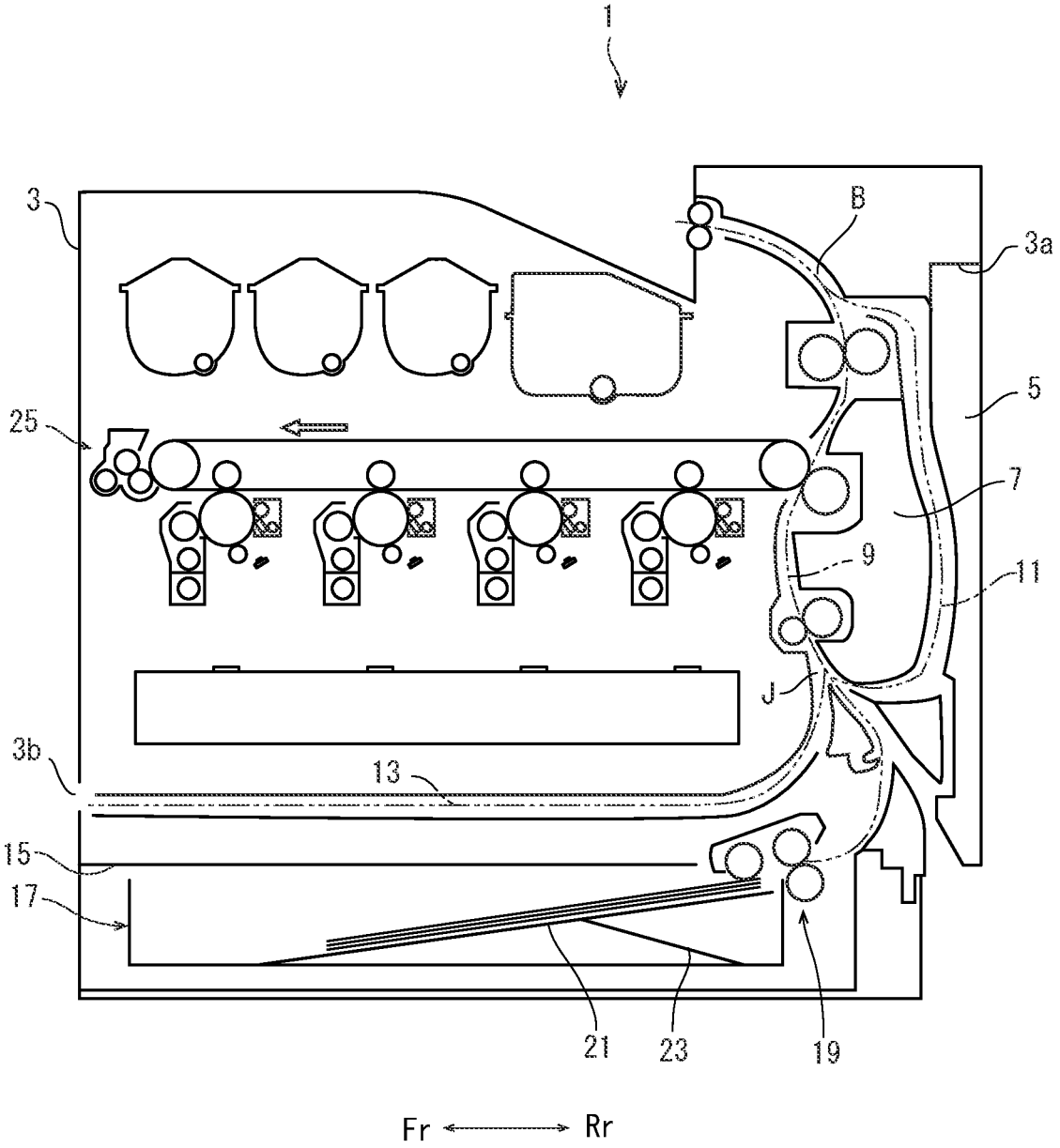
FIG. 1 is a front view schematically showing an inner structure of an image forming apparatus according to one embodiment of the present disclosure.

First, with reference to FIG. 1, the entire structure of the image forming apparatus 1 according to this embodiment will be described. FIG. 1 is a front view schematically showing the internal structure of the image forming apparatus 1. In the following description the left side of the paper plan on which FIG. 1 is drawn is defined as the front side of the image forming apparatus 1. In each figure, Fr, Rr, L and R indicate the front, rear, left and right sides of the image forming apparatus 1, respectively.

The apparatus main body 3 of the image forming apparatus 1 includes a rear cover 5 which opens and closes an opening 3*a* provided on the rear surface and a conveying unit 7 disposed inside the rear cover 5. The rear cover 5 and the conveying unit 7 are supported by the apparatus main body 3 so as to be pivoted around their lower ends. A main conveyance path 9 extending from the lower side to the upper side is formed between the apparatus main body 3 and the conveying unit 7. An approximately C-shaped inversion conveyance path 11 in the side view is formed between the conveying unit 7 and the rear cover 5. When the rear cover 5 is turned downward, the inversion conveyance path 11 is opened, and when the conveying unit 7 is turned downward together with the rear cover 5, the main conveyance path 9 is opened.

The sheet is conveyed along the main conveyance path 9 in the conveying direction from the lower side to the upper side. The inversion conveyance path 11 is branched from the main conveyance path 9 at a downstream branch point B in the conveying direction and merged with the main conveyance path 9 at an upstream junction point J. Furthermore, a manual sheet feeding path 13 is formed in the apparatus main body 3. The manual sheet feeding path 13 is formed almost horizontally from the manual sheet feeding port 3*b* formed on the front surface of the apparatus main body 3 toward the junction point J, and merged with the main conveyance path 9 at the junction point J.

The apparatus main body 3 includes a cassette housing part 15 below the manual sheet feeding path 13. The cassette housing part 15 is opened to the front surface of the apparatus main body 3. A sheet feeding cassette 17 is detachably housed in the cassette housing part 15. The cassette housing part 15 includes a sheet feeding device 10 which feeds the sheets from the sheet feeding cassette 17 to the main conveyance path 9. The direction in which the sheet is fed is defined as the sheet feeding direction.

The sheet feeding cassette 17 has a shallow box shape with the upper surface opened, and is provided with a sheet placement plate 21 and a lift plate 23. The sheet placement plate 21 is arranged on the bottom plate of the sheet feeding cassette 17, and configured to be turned upward to the downstream side in the sheet feeding direction (the rear side). The lift plate 23 is arranged between the sheet placement plate 21 and the bottom plate, and configured to be turned upward and downward around the rotating shaft. As the lift plate 23 is turned upward, the sheet placement plate 21 is inclined upward toward the downstream side in the sheet feeding direction. The sheet feeding cassette 17 is attached to and detached from the cassette housing part 15 through the opening. The sheet feeding device 19 will be described later.

The apparatus main body 3 includes an image forming part 25 above the manual sheet feeding path 13. The image forming part 25 forms an image on the sheet by, for example, an electrophotographic method. The sheet fed by the sheet feeding device 19 or conveyed along the manual sheet feeding path 13 is conveyed along the main conveyance path 9, and an image is formed on the sheet in the image forming part 25.

Figure 2:
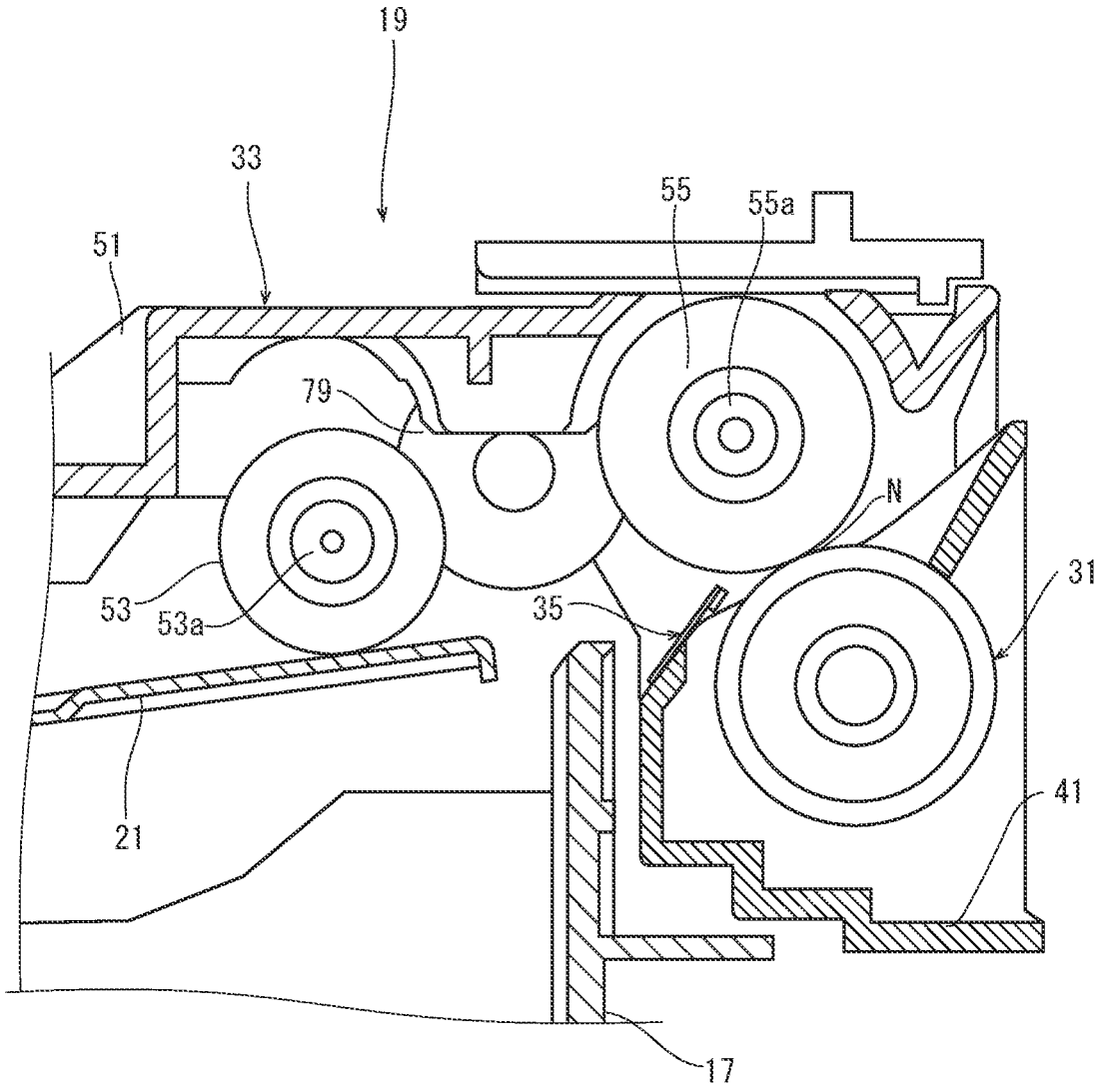
FIG. 2 is a side view showing a sheet feeding device according to the embodiment of the present disclosure.
Figure 3:
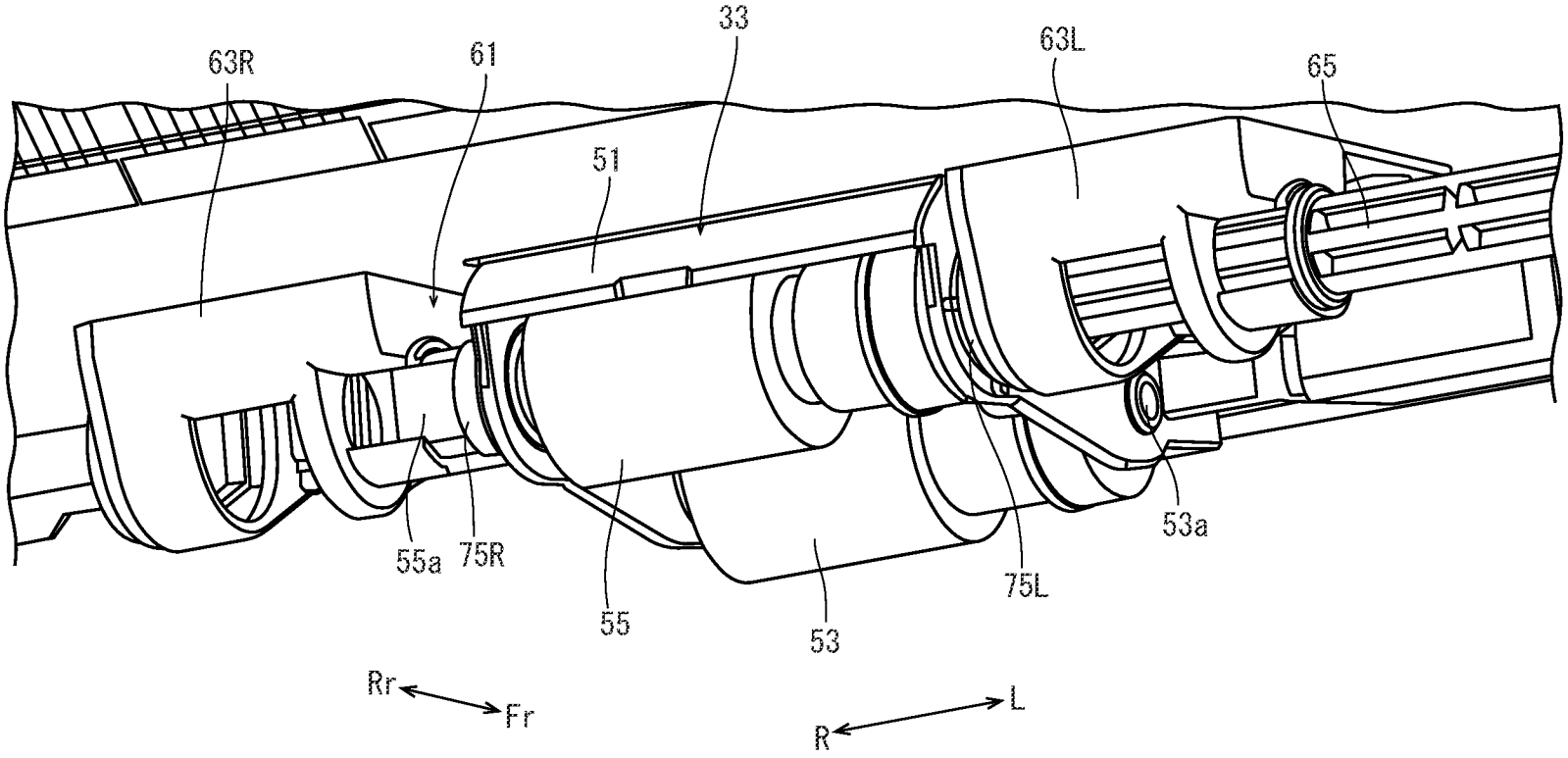
FIG. 3 is a perspective view showing a sheet feeding unit of the sheet feeding device according to the embodiment of the present disclosure, viewed from the front side.
Figure 4:
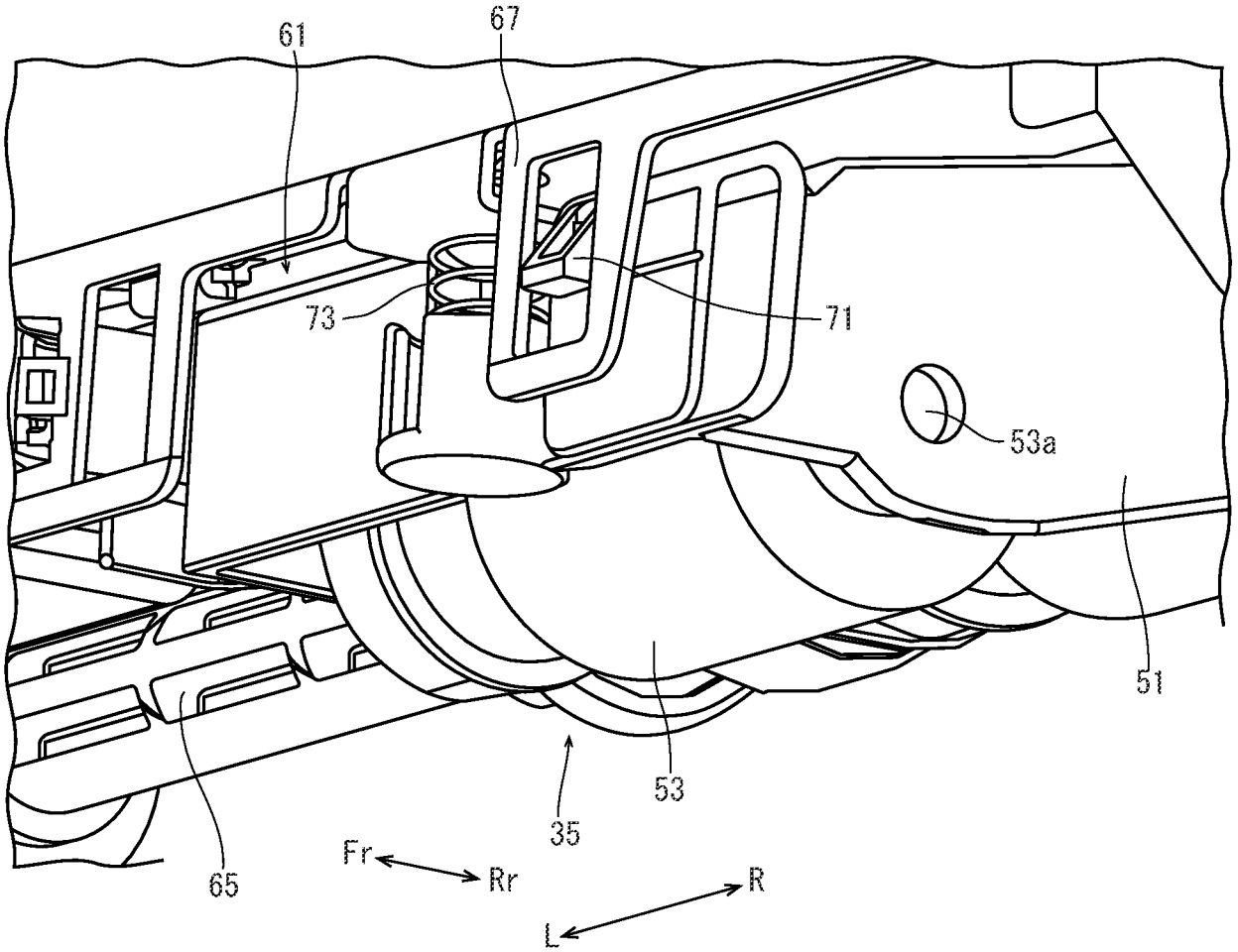
FIG. 4 is a perspective view showing the sheet feeding unit of the sheet feeding device according to the embodiment of the present disclosure, viewed from the rear side.
Figure 5:
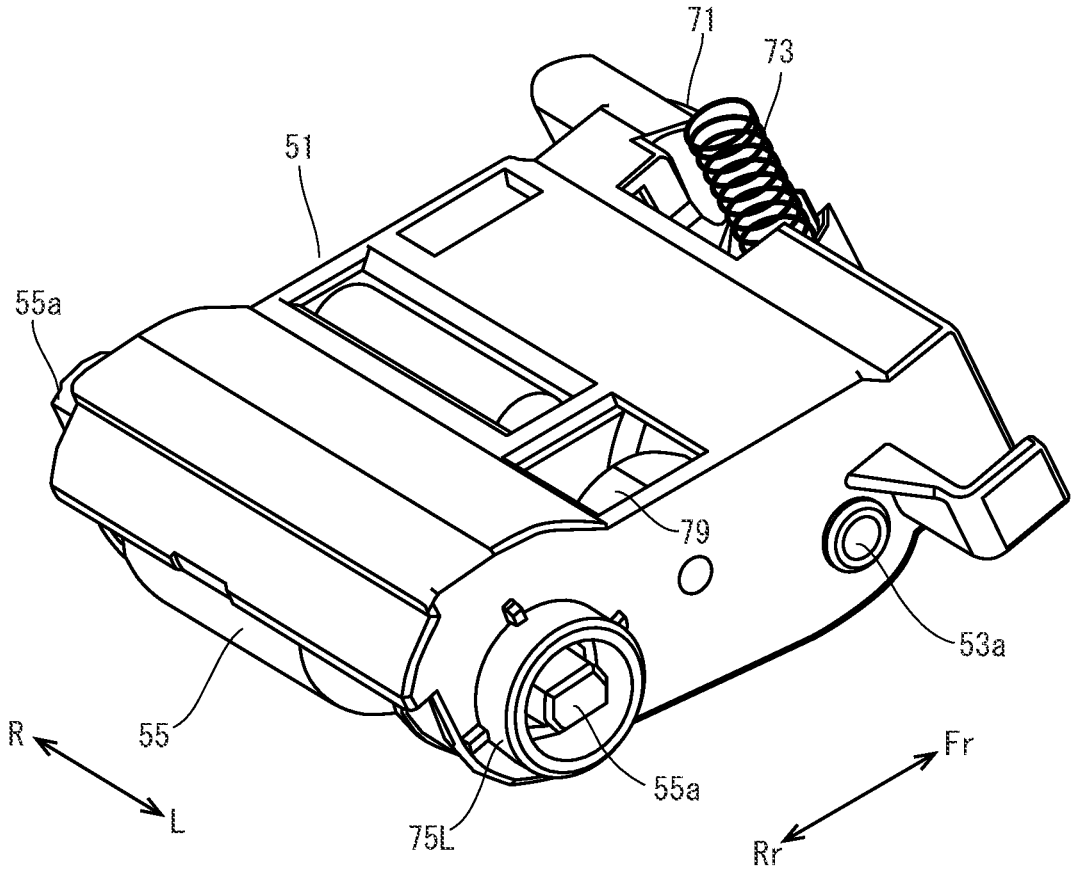
FIG. 5 is a perspective view showing a sheet feeding holder of the sheet feeding device according to the embodiment of the present disclosure.

Next, the sheet feeding device 19 will be described with reference to FIG. 1 and FIG. 2 to FIG. 4. FIG. 2 is a side view showing the sheet feeding device 19, FIG. 3 and FIG. 4 are perspective views showing the sheet feeding unit 33 of the sheet feeding device 19, and FIG. 5 is a perspective view showing the sheet feeding holder.

As shown in FIG. 2, the sheet feeding device 19 includes a separation roller 31, a sheet feeding unit 33, and a cleaning member 35.

As shown in FIG. 2, the separation roller 31 is held by a roller holder 41. The roller holder 41 is supported by the rear end portion of the cassette housing part 15 (see FIG. 1) at the center portion in the width direction (the front-and-rear direction) crossing the sheet feeding direction, and is biased upward by a biasing member (not shown). The separation roller 31 is rotatably supported by the rotating shaft through a torque limiter (not shown). The separation roller 31 stops until a torque exceeding a predetermined torque is applied, and when a torque exceeding the predetermined torque is applied, it idles with respect to the rotating shaft.

Next, the sheet feeding unit 33 will be described. The sheet feeding unit 33 is provided with a sheet feeding holder 51, a sheet feeding roller 53 and a sheet conveying roller 55 supported by the sheet feeding holder 51.

First, a unit housing part 61 to which the sheet feeding unit 33 is detachably attached will be described with reference mainly to FIG. 3 and FIG. 4. The unit housing part 61 is formed in the rear end portion of the upper wall of the cassette housing part 15 (see FIG. 1) at the center portion in the width direction.

As shown in FIG. 3, the unit housing part 61 has left and right side wall parts 63L and 63R facing each other with a predetermined space in the width direction, and the sheet feeding unit 33 is mounted between the left and right side wall parts 63L and 63R. A tip end of a drive input shaft 65 is supported on the left side wall 63L. The drive input shaft 65 is driven by a motor (not shown) to be rotated. As shown in FIG. 4, an engaging piece 67 projecting downward is formed at the front end of the unit housing part 61.

Next, the sheet feeding holder 51 will be described mainly with reference to FIG. 5. The sheet feeding holder 51 is a nearly rectangular box-shaped member with the lower surface opened, and has an upper plate, a front plate, and left and right side plates. A projection 71 projecting forward (see also FIG. 3) is formed on the outer surface of the front plate. On the outer surface of the front plate, a coil spring 73 is further supported in a posture along the upper-and-lower direction. The lower end of the coil spring 73 is supported by the spring receiver and the upper end is free. Cylindrical left and right bearing parts 75L and 75R are formed in the rear end portions of the left and right side plates.

Both the end portions of the rotating shaft 53*a* of the sheet feeding roller 53 are rotatably supported between the front end portions of the left and right side plates of the sheet feeding holder 51. Both the end portions of the rotating shaft 55*a* of the sheet conveying roller 55 are rotatably supported by the left and right bearing parts 75L and 75R of the sheet feeding holder 51. The right end portion of the rotating shaft 55*a* of the sheet conveying roller 55 projects outward from the right bearing part 75R. A gear fixed to the rotating shaft 53*a* of the sheet feeding roller 53 and a gear fixed to the rotating shaft 55*a* of the sheet conveying roller 55 are connected via an idle gear 79.

As shown in FIG. 3, the sheet feeding holder 51 is inserted between the left and right side walls 63L and 63R of the unit housing part 61. The left end portion of the rotating shaft 55*a* of the sheet conveying roller 55 is connected to the tip end portion of the drive input shaft 65 supported by the left side wall 63L, and the right end portion of the rotating shaft 55*a* of the sheet conveying roller 55 is supported by the right wall 63R. Furthermore, as shown in FIG. 5, the projection 71 formed on the front plate is snap-fit connected to the engaging piece 67 of the unit housing part 61 so as to be movable in the upper-and-lower direction.

When the sheet feeding holder 51 is thus attached to the unit housing part 6, as shown in FIG. 4, the coil spring 73 is compressed between the sheet feeding holder 51 and the upper wall of the cassette housing part 15 to bias the sheet feeding holder 51 downward. As a result, the sheet feeding holder 51 is biased downward around the rotating shaft 55*a* of the sheet conveying roller 55. That is, the sheet feeding roller 53 is biased downward. Thus, the sheet conveying roller 55 comes into contact with the separation roller 31 to form a separation nip N between the two rollers.

Figure 6A:
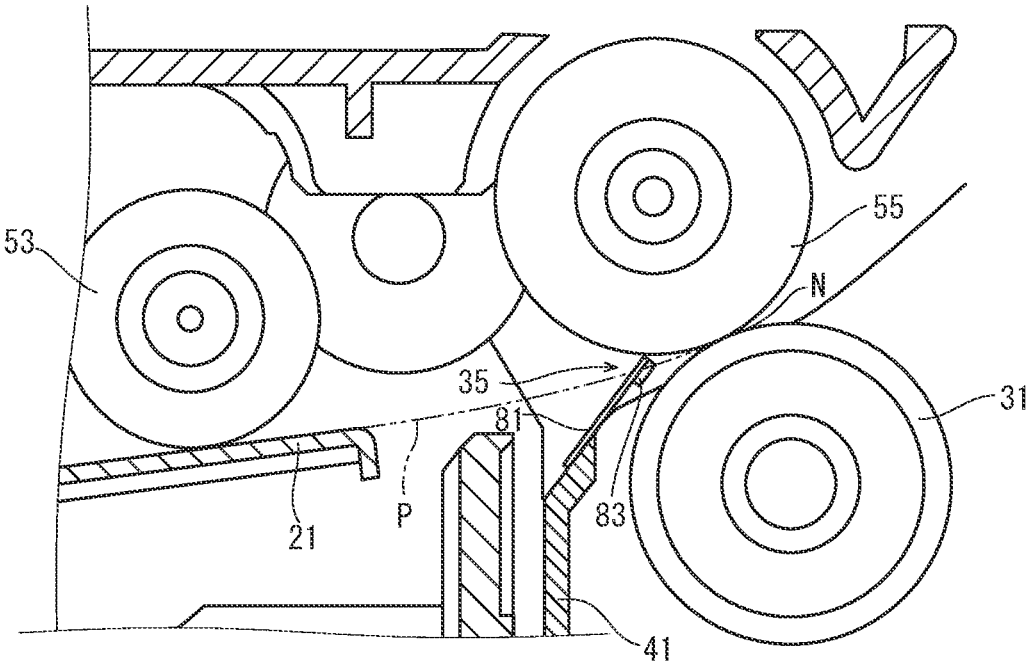
FIG. 6A is a side view showing a cleaning member (in a state where a sheet is not fed) in the sheet feeding device according to the embodiment of the present disclosure.
Figure 6B:
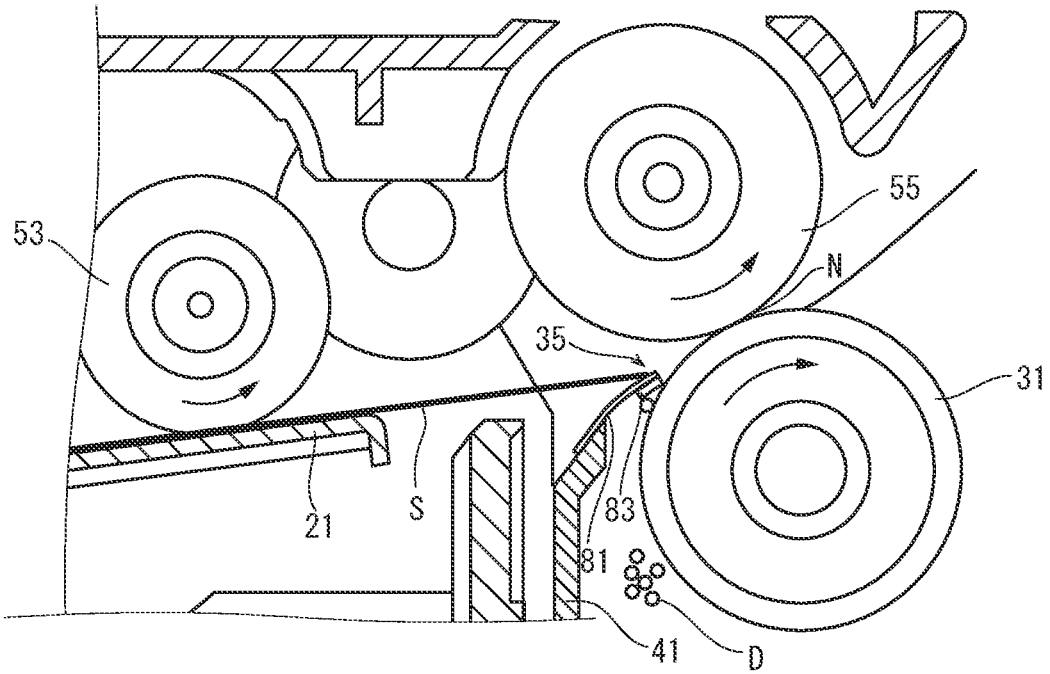
FIG. 6B is a side view showing the cleaning member (in a state where the sheet is being fed) in the sheet feeding device according to the embodiment of the present disclosure.

Next, the cleaning member 35 will be described with reference to FIG. 6A and FIG. 6B. FIG. 6A and FIG. 6B are side views showing the cleaning member 35.

The cleaning member 35 includes an elastic piece 81 cantilevered by the roller holder 41 and a brush 83 supported on the free end of the elastic piece 81. The elastic piece 81 has a width equal to the width of the separation roller 31 and a predetermined length. As shown in FIG. 6A, the elastic piece 81 is supported on the upstream side of the separation nip N in the sheet feeding direction so as to cross the sheet feeding path P between the contact point between the sheet feeding roller 53 and the sheet and the separation nip N. The elastic piece 81 is supported on the roller holder 41 using, for example, a double-sided tape or an adhesive. The brush 83 is fixed to the surface of the elastic piece 81 facing the surface of the separation roller 31 along the free end. The brush 83 is supported by the elastic piece 81 using, for example, a double-sided tape or an adhesive. The elastic piece 81 is made of, for example, PET film. The brush 83 is made of, for example, an elastic body such as a sponge or rubber, a bristle brush, or a raised cloth.

The sheet feeding operation and the separation roller cleaning operation in the sheet feeding device 19 having the above configuration will be described with reference to FIG. 6A and FIG. 6B. When the sheet feeding cassette 17 containing the sheets is attached to the cassette housing part 15, the lift plate 23 is turned to incline the sheet placement plate 21 upward. This causes the uppermost sheet S to be in contact with the sheet feeding roller 53.

Then, the drive input shaft 65 is driven to be rotated, and the sheet conveying roller 55 is rotated in the counterclockwise direction in the figure. The rotation of the drive input shaft 65 is transmitted through the idle gear 79 to the sheet feeding roller 53, and the sheet feeding roller 53 is rotated in the counterclockwise direction in the figure. Thus, the uppermost sheet S with which the sheet feeding roller 53 is in contact is fed along the sheet feeding direction. The fed sheet S is separated at the separation nip N, and then conveyed to the main conveyance path 9 (see FIG. 1). In addition, following the rotation of the sheet conveying roller 55, the separation roller 31 is rotated in the clockwise direction in the figure.

When the sheet S is fed in this manner, the leading edge of the fed sheet S abuts against the cleaning member 35 on the upstream side of the separation nip N in the sheet feeding direction, as shown in FIG. 6B. Then, the elastic piece 81 is pushed by the leading edge of the sheet and elastically deformed downward, and the brush 83 comes into contact with the surface of the separation roller 31 from the upstream side in the rotational direction of the separation roller 31. If the brush 83 is made of an elastic body, the edge or surface of the elastic body comes into contact with the surface of the separation roller 31. The brush 83 continues to be in contact with the surface of the separation roller 31 while the sheet is being conveyed. As a result, the surface of the separation roller 31 is rubbed by the brush 83, and the sheet powder or the like D adhering to the surface is removed. The removed sheet powder D passes through the gap between the separation roller 31 and the roller holder 41, and falls into the roller holder 41. The roller holder 41 may be provided with a recovery part for recovering the fallen sheet powder.

When the trailing edge of the fed sheet S is separated from the cleaning member 35, the elastic piece 81 is elastically restored and the brush 83 is separated from the surface of the separation roller 31 (see FIG. 6A).

As explained above, according to the present disclosure, the cleaning member 35 for cleaning the separation roller 31 comes into contact with the surface of the separation roller 31 only while the sheet is being fed, and separates from the surface of the separation roller 31 when the sheet feeding is stopped. Thus, since the contact time between the cleaning member 35 and the separation roller 31 can be as short as possible, wear of the surface of the separation roller 31 by the cleaning member 35 can be prevented, and wear of the brush 83 of the cleaning member 35 can also be prevented. Therefore, the cleaning performance by the cleaning member 35 can be maintained.

In addition, since the brush 83 comes into contact with the surface of the separation roller 31, the sheet powder and the like adhering to the surface can be surely removed by the brush 83.

Although the disclosure has been described for a specific embodiment, the disclosure is not limited to the above embodiment. A person skilled in the art can modify the above embodiment as long as it does not deviate from the scope and spirit of the disclosure.

The invention claimed is:

1. A sheet feeding device comprising:

a sheet feeding roller which comes into contact with a sheet and then is rotated to feed the sheet in a predetermined sheet feeding direction;

a sheet conveying roller disposed on a downstream side of the sheet feeding roller in the sheet feeding direction;

a separation roller forming a separation nip between the sheet conveying roller and the separation roller, and conveying the sheet while separating the sheets at the separation nip; and a cleaning member disposed on an upstream side of the separation nip in the sheet feeding direction, and cleaning a surface of the separation roller, wherein the cleaning member is configured to be deformable to be separated from the surface of the separation roller when the sheet feeding roller does not feed the sheet and to come into contact with the surface of the separation roller by the sheet fed by the sheet feeding roller.

2. The sheet feeding device according to claim 1, wherein the cleaning member includes:

an elastically deformable elastic piece cantilevered on the upstream side of the separation nip in the sheet feeding direction; and a brush supported by a free end of the elastic piece, the elastic piece is pushed by the sheet fed by the sheet feeding roller to be elastic deformed and to be in contact with the surface of the separation roller, and when the sheet is separated from the elastic piece, the elastic piece is elastically restored and separated from the surface of the separation roller.

3. The sheet feeding device according to claim 1, wherein the cleaning member is supported so as to cross a sheet feeding path between a contact point between the sheet feeding roller and the sheet, and the separation nip, on the upstream side of the separation nip in the sheet feeding direction.

4. The sheet feeding device according to claim 1, wherein the brush comes into contact with the surface of the separation roller from an upstream side in a rotational direction of the separation roller.

5. The sheet feeding device according to claim 1, comprising:

a roller holder by which the separation roller is rotatably supported, wherein sheet powder removed by the cleaning member from the separation roller falls inside the roller holder.

6. An image forming apparatus comprising:

the sheet feeding device according to claim 1; and an image forming part which forms an image on the sheet fed by the sheet feeding device.

* * * * *